US005445251A

United States Patent [19]

Redwood

[11] Patent Number: 5,445,251

[45] Date of Patent: Aug. 29, 1995

[54] BINDER OR PORTFOLIO

[75] Inventor: Richard Redwood, Union, Mo.

[73] Assignee: American Trading & Production Corporation, Baltimore, Mass.

[21] Appl. No.: 100,608

[22] Filed: Aug. 2, 1993

[51] Int. Cl.[6] ..... A45C 3/00

[52] U.S. Cl. ..... 190/109; 206/524; 229/800

[58] Field of Search ..... 190/109, 110; 206/523, 206/524, 588; 229/1.5 R

[56] References Cited

U.S. PATENT DOCUMENTS

| | | | |
|---|---|---|---|
| 2,426,503 | 8/1947 | Herbener | 150/147 |
| 2,536,169 | 1/1951 | Gray | 190/110 X |
| 2,959,340 | 11/1960 | Hennessey | 206/588 X |
| 3,565,148 | 2/1971 | Miller | 150/147 |
| 3,769,741 | 11/1973 | Hessler | 206/523 X |
| 4,093,010 | 6/1978 | Hunley et al. | 206/523 X |
| 4,106,597 | 8/1978 | Shook et al. | 190/110 |
| 4,711,348 | 12/1987 | Schluger | 206/523 X |
| 4,754,880 | 7/1988 | Tehrani | 206/588 X |
| 5,295,580 | 3/1994 | Hicks | 206/588 |

FOREIGN PATENT DOCUMENTS

| | | | |
|---|---|---|---|
| 9201403 | 2/1992 | WIPO | 190/109 |

OTHER PUBLICATIONS

Atapco Office Products Group, "Hazel Business Accessories" brochure, printed in U.S.A. 1992.

*Primary Examiner*—Allan N. Shoap
*Assistant Examiner*—Christopher J. McDonald
*Attorney, Agent, or Firm*—Cohn, Powell & Hind

[57] ABSTRACT

A portfolio (10) includes a first panel (12), a second panel (14) hingedly attached to one side of the first panel (12) and a third panel (16) hingedly attached to the other side of the first panel (12). The first panel (12) includes provision in the form of cut-outs 200–216 for receiving and storing business accessories such as a calculator, a Post-it note pad, paper clips, and a ball point pen, for example, in the form of a resilient foam block (26) provided with cut-outs (210–216) shaped to suit the accessories. The second panel (14) provides a cover which is foldable over the first panel (12) and held in place by the third panel (16), the cover (14) being sandwiched between said first and third panels. The third panel (116) is adapted to receive a writing pad J. A modified portfolio (110) includes a fourth panel (118) which cooperates with the second panel (114) to provide a closure for the binder (110).

3 Claims, 3 Drawing Sheets

10
12
14
15
16
26'
206'
D
22
20

B
202

216
218
26
I
23
22
15
J
43
44
42
45
47
25
24
12
14
35
32
34
33
36
13
S

206

46
E
208

210
200
A

C
204
38

10
12
14
7
16
26
216
46
42
47
36
11
13
J
15
S
38
20
11
S
20

14
38
36
15

J
26
12
10
16
20

14
D
10
20
216
218
42
46
16
206
202
48
8
8
6
6
9
9
A
214
15
J
E
210
G
26
13
200
10
208
212
C
10
204

14
48
13
15
J
38
36
10

26
12
16

BINDER OR PORTFOLIO

BACKGROUND OF THE INVENTION

This invention related generally to binders or portfolios and particularly to a portfolio having a covered storage compartment for business accessories.

The most common form of transporting documents and business accessories such as calculators, writing pads, pens, Post-it pads and the like is the conventional briefcase. Briefcases vary in complexity and frequently include multiple storage compartments for such business accessories and are useful for carrying such accessories and documents on business trips. However, there are times when a smaller unit such as a portfolio or binder is desirable which can store some of the accessories and which is readily portable. Such binders are particularly useful for local business visits, or for carrying around documentary information as well as some accessories from office to office during a business visit. Many such underarm portfolios with pad holders, sometimes referred to as padfolios are available for carrying writing pads, pens, Post-it notes, and the like, but the accessories are not always readily accessible in the multiple fold pockets provided by such portfolios. Accordingly, there is a need for a portfolio which can carry business accessories such as a calculator, pen, paper clips, and the like, in a readily accessible form so that they are easy to locate and replace and are not likely to fall out of the portfolio and, moreover, can readily be carried in the portfolio within a briefcase so that such accessories are not lost in the pockets of the more voluminous briefcase.

The portfolio of the present invention addresses and solves these problems in a manner not disclosed in the known prior art.

SUMMARY OF THE INVENTION

This invention provides a portfolio arrangement having folding panels holding convenience items or business accessories securely when the portfolio is folded for carrying, yet which are readily accessible when the portfolio is open for use.

This portfolio comprises a first panel including means for receiving and storing one or more business accessories, a second panel attached to said first panel in foldable relation to provide a cover for the business accessories stored on said first panel, a third panel attached to said first panel in foldable relation to said first and second panels.

It is an aspect of this invention to provide that said first panel receiving and storing means includes means providing compatibly configurated reception areas sized to suit said business accessories.

It is another aspect of this invention to provide that said first panel receiving and storing means includes a block having cut-outs sized to suit said business accessories.

It is another aspect of this invention to provide that said block is formed from a deformable foam sheet having said cut-outs sized to hold said business accessories in press-fit relation.

It is yet another aspect of this invention to provide that said block is of sufficient thickness that said second panel providing said cover fits substantially flat against said block.

It is still another aspect of this invention to provide that said second panel is operatively sandwiched between said first and third panels to inhibit movement of said second panel away from said first panel.

Another aspect of this invention is to provide that said third panel includes means for receiving note taking means, It is an aspect of this invention to provide that said first, second and third panels are substantially of equal width.

It is another aspect of this invention to provide that one of said panels includes a flap providing a pocket.

Another aspect of this invention is to provide a fourth panel attached to said third panel in foldable relation.

It is an aspect of this invention to provide that said fourth panel includes a fastening means and one of said first and second panels includes a cooperating fastening means to hold said first, second, third and fourth panels in folded relation.

It is still another aspect of this invention to provide that said first panel and said second panels are substantially of equal width, said third and fourth panels are of substantially equal width and wider than said first and second panels and said fourth panel includes a fastening means and said second panel includes a cooperating fastening means to hold said first, second, third and fourth panels in folded relation.

It is yet another aspect of this invention to provide that at least one cut-out is sized to suit a pen or other writing implement, another aspect to provide that at least one cut-out is sized to suit an adhesive note pad, another aspect to provide that at least one cut-out is sized to suit an electronic calculator, and another aspect to provide that at least one cut-out includes a magnetic back strip to provide a paper clip container.

It is another aspect of this invention to provide that said first panel receiving and storing means includes a molded plastic form having cavities sized to suit said business accessories.

It is an aspect of this invention to provide a portfolio which is relatively simple and inexpensive to manufacture and particularly effective for its intended purpose.

DESCRIPTION OF THE PREFERRED EMBODIMENTS

Figures 1, 6, 7, 8, 9, 10, 11, 15:
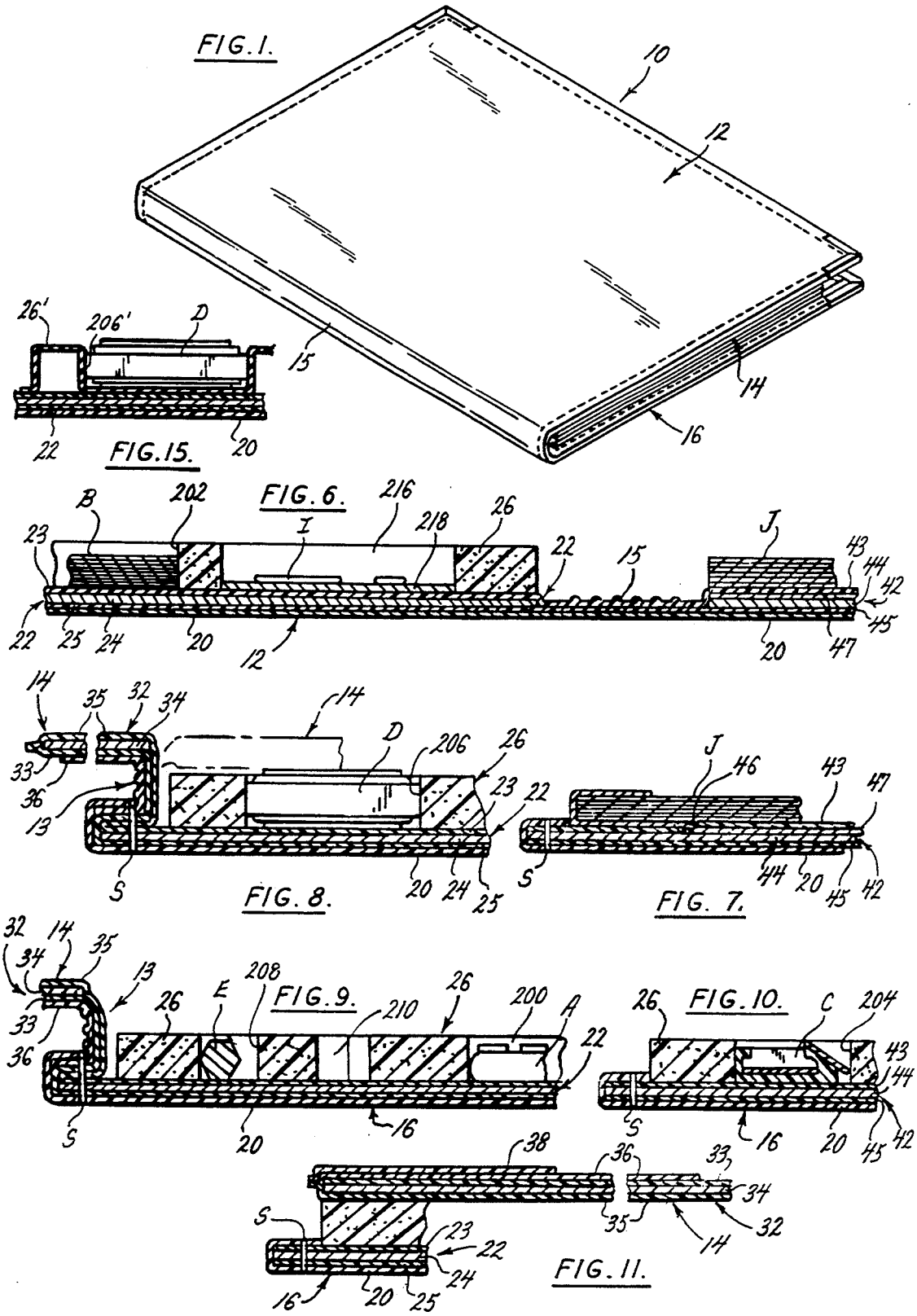
FIG. 1 is a perspective view of the portfolio in the folded condition.
FIG. 6 is an enlarged cross-sectional view taken on line 6—6 of FIG. 4.
FIG. 7 is a cross-sectional view taken on line 7—7 of FIG. 6.
FIG. 8 is an enlarged cross-sectional view taken on line 8—8 of FIG. 4.
FIG. 9 is an enlarged cross-sectional view taken on line 9—9 of FIG. 4.
FIG. 10 is an enlarged cross-sectional view taken on line 10—10 of FIG. 4.
FIG. 11 is an enlarged fragmentary cross-sectional view taken on line 11—11 of FIG. 2.
FIG. 15 is a similar view to FIG. 8 showing a molded plastic form storage compartment.

Referring now by reference numerals to the drawings and first to FIGS. 1–5 it will be understood that the portfolio 10, in the embodiment shown, consists essentially of three interconnected panels 12, 14 and 16. The first panel 12 includes means for receiving and storing convenience items or business accessories. The second panel 14 is hingedly attached to the first panel 12 and folds over the first panel 12 to provide a flat cover for the convenience items. The third panel 16 is hingedly attached to the first panel 12 and is foldable over the cover panel 14 to sandwich the cover panel between the first panel 12 and the third panel 16 thereby inhibiting the cover panel 14 from opening, during carrying, when the portfolio 10 is folded into a compact unit as shown in FIG. 1.

More specifically, and as shown in FIGS. 6 and 8, the first panel 12 includes an outer cover component 20 of relatively thick sheet material such as soft vinyl or leather, and a compound ply inner stiffening component 22 consisting of an intermediate ply 24 of cardboard, or the like, sandwiched between two plies 23 and 25 of relatively thin sheet vinyl, or the like. The inner component 22 is attached to the outer component, as by folding the outer component edges over the inner component and attaching, as by stitching S or adhesive. The two components 20 and 22 cooperate to provide a covered stiff base for a foam plastic pad or block 26 storage compartment of resilient, deformable polyurethane, polyether or the like, 26 which is attached, as by adhesive, to the inner component 22. The block 26, in the embodiment shown, includes cut-outs and constitutes a means providing compatibly configurated reception areas sized to suit and hold at least one accessory.

Figure 4:
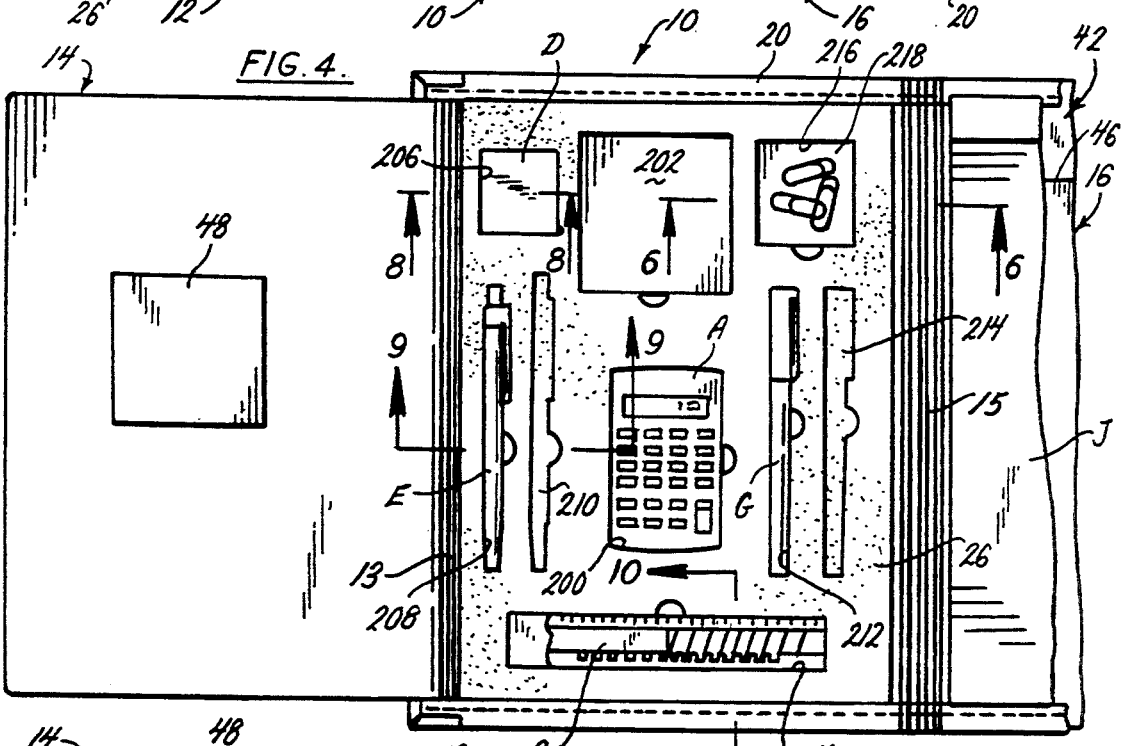
FIG. 4 is a plan view similar to FIG. 2 but with the storage compartment cover open.
Figure 5:
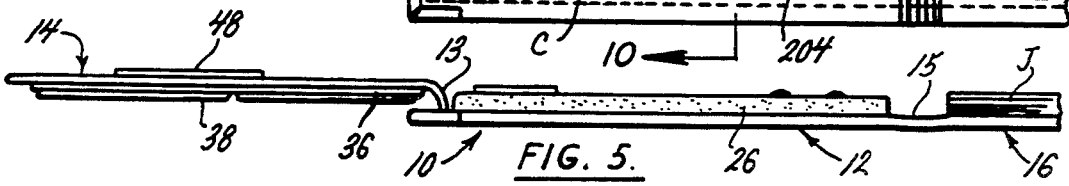
FIG. 5 is a side view similar to FIG. 3 but with the storage compartment cover open.

As shown in FIG. 4 in general, and FIGS. 6–11 in particular, the foam block 26 is provided with cut-outs 220–216. The cut-outs, nine in number in the embodiment shown, receive and hold office or student convenience items or business accessories such as an electronic calculator A (cut-out 200), a Post-it note pad B (cut-out 202), an Exacto-knife C (cut-out 204), a tape measure D (cut-out 206), a pencil E (cut-out 208), a ballpoint pen (cut-out 210), and two colored highlighters or marker pens G (cut-outs 212 and 214 respectively). The cut-out for each of these items is slightly smaller than the item itself so that the item is held in place by pressure from the foam margins and each cut-out also includes a semi-circular portion to facilitate finger removal of the item. In the embodiment shown, an empty cut-out 216 is provided having a magnetic back strip 218 for receiving and holding wire paper clips.

Figure 2:
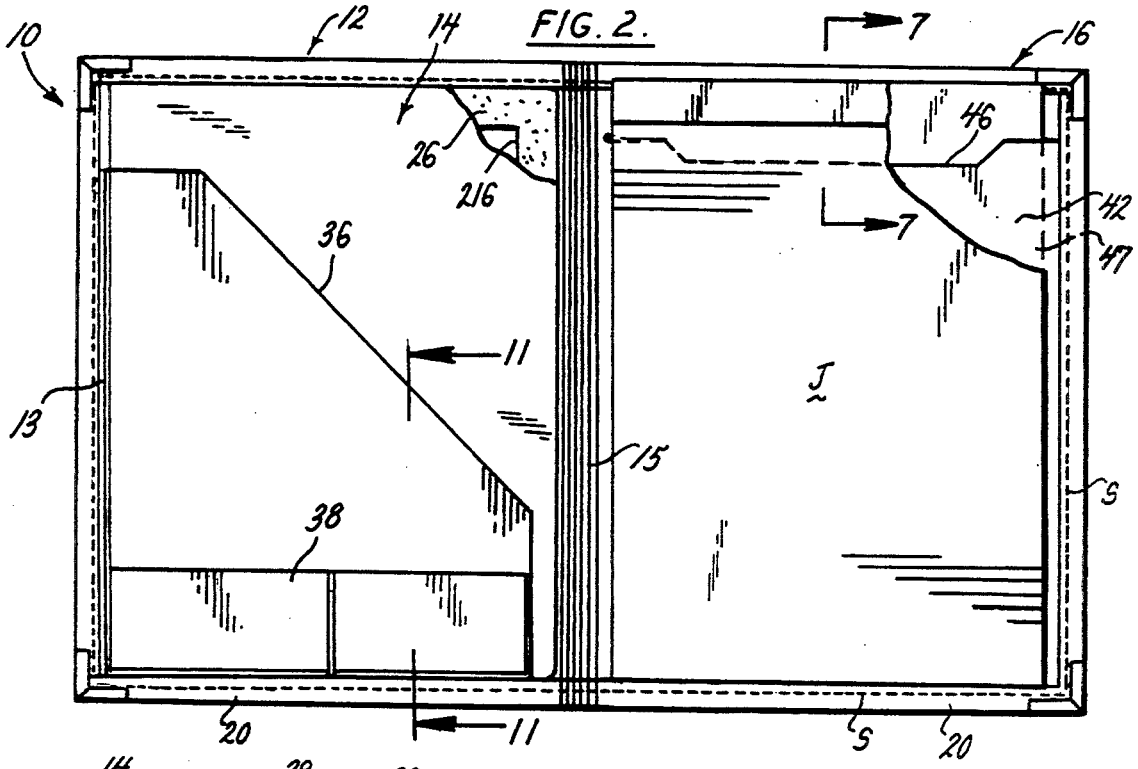
FIG. 2 is a plan view of the portfolio in the open position but with the storage compartment cover closed.
Figure 3:
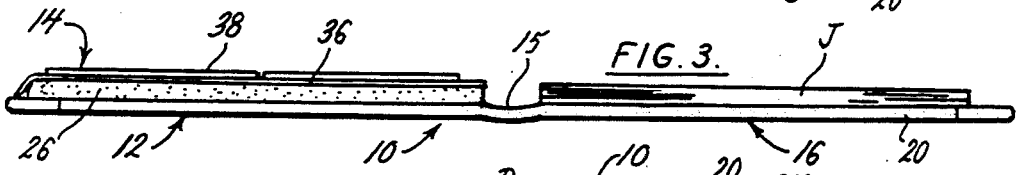
FIG. 3 is a view taken from the bottom side.

The cover panel 14, as shown in FIG. 8, includes compound ply component 32 similar to inner component 22 consisting of an intermediate ply 34 of cardboard sandwiched between two plies 33 and 35 of relatively thin sheet vinyl. As shown in FIG. 2, a flap ply 36 forming a large pocket for loose papers is also part of the cover panel 14 and is attached to the ply 33 as by heat sealing, said flap having an overlying ply 38 attached thereto as by heat sealing and forming a pair of supplementary pockets.

As best shown in FIG. 8, the first panel 12 and the cover panel 14 are hingedly attached. The attachment is made by sealing the sandwiching plies 33 and 35 and the flap ply 36 together to form a ribbed hinge section 13; turning the edge of-the hinge section 13 into overlying relation with the edge of the first panel inner component 32, turning the edge of the first panel outer component 20 over the edge of the compound ply inner component 22 and the hinge section 13, and attaching the hinge section 13 and the two components 20 and 22 together, as by stitching S or adhesive. As shown in FIG. 4 the flat, obstruction-free inside surface of the panel 14 provides an ideal surface for storing used Post-it adhesive note sheets 48. The panel 14 also fits substantially flat against the block 26 over the accessories to act as a cover or lid.

The third panel 16 is formed like the first panel 12 and includes the cover component 20, a compound ply inner stiffener component 42 having an intermediate ply 44 of cardboard, sandwiched between two plies 43 and 45 attached to the outer component as by stitching S. The inner component ply 43 is slit widthwise at 46 to receive the rear sheet 49 of a writing pad A.

As best shown in FIG. 6, the first panel 12 and third panel 16 are integrally formed from a common outer ply and common inner ply of the inner component of the two panels, which plies are adhesively, or heat sealingly, attached to provide a ribbed hinge section 15. The outer component, in the preferred embodiment, is not attached to the inner component plies at the hinge section but is preferably free from attachment. The hinge action is facilitated by the ribbed formation of hinge sections 13 and 15. Corner reinforcement elements 50 are provided to protect the corners of the panels.

Figures 12, 13, 14:
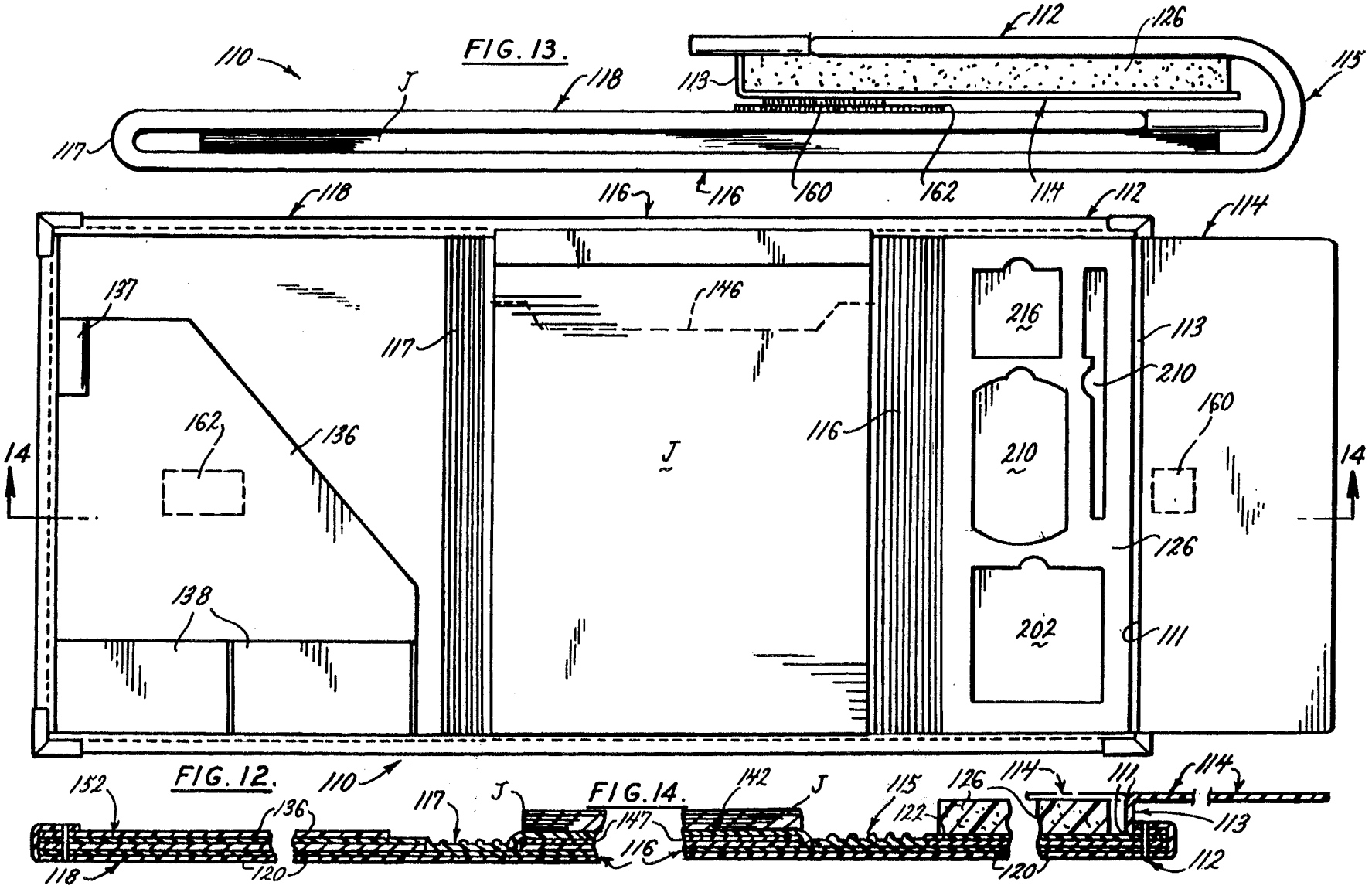
FIG. 12 is a plan view of a modified portfolio with the storage compartment cover in the open position.
FIG. 13 is an enlarged side view of the portfolio of FIG. 12 with the portfolio in the folded condition.
FIG. 14 is an enlarged fragmentary cross sectional view taken on line 14—14 of FIG. 12.

A modified portfolio 110 is shown in FIGS. 12–14 which is similar to portfolio 10 in many respects but distinguished from portfolio 10 in some respects. Similar parts are given the same numeral with a prefix numeral 1 for convenience.

Referring to FIGS. 12–14 the portfolio 110, in the embodiment shown, consists essentially of four interconnected panels 112,114, 116 and 118. The first panel 112 includes means for receiving and storing business accessories. The second cover panel 114 is hingedly attached to the first panel 112 at a hinge section 113 in a manner similar to that shown for the previous embodiment, see FIG 14, and folds over the first panel 112 to provide a flat cover for the business accessories.

Similar to the previous embodiment, the first panel 112 includes an outer cover component 120 and an inner stiffener component 122. Distinguishing from the previous embodiment, the cover panel 14 is provided by a single ply of flexible plastic sheet material such as expanded polyethylene having two spaced bend lines 111 defining the hinge section 113, as shown in FIG. 14. The attachment to the first panel 112, as by stitching, is substantially the same as for the previous embodiment.

The third panel 116 is formed in a manner similar to the previous embodiment and includes the cover component 120 and a stiffener component 122, and is hingedly attached to the first panel 112 at a hinge section 115 in a manner similar to that shown for the previous embodiment, see FIG. 14. Panel 116 is provided with a slit 146 to receive a writing pad J.

The modified portfolio 110 is distinguished from the first embodiment in that a fourth panel 118 is provided which is foldable over the third panel 116 at a hinge section 117, also in a manner similar to that shown for the previous embodiment, see FIG. 14. The fourth panel 118 is formed in a manner similar to the third panel 116 and includes the cover component 120, and a stiffener component 152. The second cover panel 114 is folded over the first panel 112 and the first and second panels 112 and 114 together are foldable over the third and fourth panels 116 and 118. In the modified portfolio 110, the first and second panels 112 and 114 are about half the width of the third and fourth panels 116 and 118 and the front face of the second cover panel 114 is provided with a fastener 160 which, in the embodiment shown is a Velcro component which cooperates with a mating component 162 provided on the rear face of the fourth panel 118. This arrangement provides that the second cover panel 114 is sandwiched between the first panel 112 and third panel 116 as shown in FIG. 12 but with the fourth panel 118 intervening between the second and third panels 114 and 116. By this arrangement the cover panel 114 is inhibited from opening during carrying.

As discussed above the first, second and third panels 112,114 and 116 are formed in substantially the same way as the first, second and third panels 12, 14 and 16 of the first embodiment. However, because of the smaller area of the first panel 112 the number of cut-outs for convenience items or business accessories is less. For example, in the embodiment shown, corresponding cut-outs are provided for four items such as a calculator A (cut-out 200), a Post-it note pad B (cut-out 202), a tape measure D (cut-out 218) and a ball-point pen F (cut-out 210). Also, in the modified binder 110 the added panel 118 is provided with a flap 136 and pockets 138, rather than the cover panel 114, and in addition the flap 136 is provided with a sleeve 137 for receiving a pencil E (not shown). It will be understood that the items received and stored in the foam block of the first panel are not limited to those listed but could be, for example, drafting instruments or artists supplies.

It will also be understood that the portfolio is not limited to using a foam block with cut-outs for providing the storage compartment but can use other means for providing compatibly configurated reception areas which are sized to suit the business accessories. For example, such storage compartment can be unitarily formed from plastic such as high density polyethylene or the like as by vacuum thermoforming, injection molding, or the like into a molded sheet 26' formed into cavities, such as cavity 206', as shown in FIG. 15 which is attached to said first panel, as by adhesive, or the like.

Although the invention has been described by making detailed reference to two preferred embodiments, such detail is to be understood in an instructive rather than in any restrictive sense, many other variants being possible within the scape of the claims here unto appended.

I claim as my invention:

1. A portfolio comprising:

(a) a first panel including means for receiving and storing at least one accessory, (b) a second panel attached to said first panel in foldable relation to provide a cover for the business accessories stored on said first panel, (c) a third panel attached to said first panel in foldable relation to said first and second panels, and (d) a fourth panel attached to said third panel in foldable relation and including a flap providing a pocket, and (e) said first panel and said second panels being substantially of equal width, said third and fourth panels being of substantially equal width and wider than said first and second panels and said fourth panel including a fastening means and said second panel including a cooperating fastening means to hold said first, second, third and fourth panels in folded relation.

2. A portfolio comprising:

(a) a first panel including means for receiving and storing at least one accessory, (b) a second panel attached to said first panel in foldable relation to provide a cover for the business accessories stored on said first panel, (c) a third panel attached to said first panel in foldable relation to said first and second panels., (d) said first panel receiving and storing means includes a block having cut-outs sized to suit said business accessories,.

(e) said block is formed from a deformable foam sheet having said cut-outs sized to hold said business accessories in press-fit relation, (f) at least one cut-out including a magnetic back strip to provide a paper clip container.

3. A portfolio comprising:

(a) a first panel including means for receiving and storing at least one accessory, (b) a second panel attached to said first panel in foldable relation to provide a cover for the accessories stored on said first panel, (c) a third panel attached in foldable relation to one of said first and second panels, and (d) a fourth panel attached to said third panel in foldable relation, (e) said third and fourth panels being of substantially equal width and wider than said first and second panels, and said first panel receiving and storing means and said second panel being about half the width of said third and fourth panels.

* * * * *